United States Patent [19]

Suzuki et al.

[11] Patent Number: 4,847,189

[45] Date of Patent: Jul. 11, 1989

[54] HIGH SPEED PROCESSING SILVER HALIDE PHOTOGRAPHIC LIGHT-SENSITIVE MATERIAL

[75] Inventors: Akio Suzuki; Eiji Yoshida, both of Hachioji; Satoru Nagasaki; Masumi Arai, both of Hino; Nobuaki Tsuji, Hachioji, all of Japan

[73] Assignee: Konica Corporation, Tokyo, Japan

[21] Appl. No.: 165,796

[22] Filed: Mar. 9, 1988

[30] Foreign Application Priority Data

Mar. 11, 1987 [JP] Japan ..... 62-54222

[51] Int. Cl.[4] ..... G03C 1/02; G03C 1/30; G03C 1/46

[52] U.S. Cl. ..... 430/567; 430/502; 430/569; 430/621; 430/622; 430/623; 430/626; 430/966; 430/967

[58] Field of Search ..... 430/502, 567, 569, 621, 430/622, 623, 626, 966, 967

[56] References Cited

U.S. PATENT DOCUMENTS

| | | | |
|---|---|---|---|
| 3,545,971 | 12/1970 | Barnes et al. | 96/61 |
| 4,353,977 | 10/1982 | Gerber et al. | 430/567 |
| 4,414,306 | 11/1983 | Wey et al. | 430/434 |
| 4,414,310 | 11/1983 | Daubendiek et al. | 430/567 |
| 4,433,048 | 2/1984 | Solberg et al. | 430/434 |
| 4,434,226 | 2/1984 | Wilgus et al. | 430/434 |
| 4,439,520 | 3/1984 | Kofron et al. | 430/434 |
| 4,459,353 | 7/1984 | Maskasky | 430/434 |
| 4,665,012 | 5/1987 | Sugimoto et al. | 430/567 |

FOREIGN PATENT DOCUMENTS

| | | |
|---|---|---|
| 50-56227 | 5/1975 | Japan . |
| 50-147324 | 11/1975 | Japan . |
| 53-3325 | 1/1978 | Japan . |

*Primary Examiner*—Mukund J. Shah

*Attorney, Agent, or Firm*—Finnegan, Henderson, Farabow, Garrett, & Dunner

[57] ABSTRACT

A silver halide photographic material is capable of super-rapid processing with the total time of 20 to 60 minutes and is high in sensitivity, low in fogginess and excellent in pressure resistance and graininess. The photographic material is comprises a support bearing a hydrophilic colloial layer including at least one light sensitive silver halide emulsion layer thereon, wherein silver halide grains contained in the silver halide emulsion layer are mainly comprised of tabular grains which have an aspect ratio of the grain size to the grain thickness of not lower than 5, and the projective areas of the whole tabular grain occupy not less than 50% of the projective areas of the whole silver halide grain in the emulsion layer, the melting time of the silver halide photographic light-sensitive material is within the range of from not shorter than 45 minutes, and on the side bearing the hydrophilic colloidal layer containing the silver halide emulsion layer, an amount of gelatin is within the range of from 2.00 to 3.20 g/m$^2$.

14 Claims, No Drawings

HIGH SPEED PROCESSING SILVER HALIDE PHOTOGRAPHIC LIGHT-SENSITIVE MATERIAL

This invention relates to a silver halide photographic light-sensitive material capable of being applied to a high-speed processing and, more particularly, to a silver halide photographic light-sensitive material which is, substantially, high in sensitivity, low in fogginess and excellent in both pressure resistance and graininess, even in the case that it is applied to a super-rapid processing.

BACKGROUND OF THE INVENTION

In recent years, the consumption of silver halide photographic light-sensitive materials have been on the increase.

Accordingly, the number of processing silver halide photographic light-sensitive materials has also been on the increase. It has, therefore, been required to make the processing more rapid, namely, to increase the processing quantity within the same period of time.

The above-mentioned tendencies have also been seen in the fields of X-ray light-sensitive materials such as medical X-ray films. To be more concrete, as the diagnosis frequency is rapidly increased by the promotion of regular medical inspections and so forth, the inspection items and the number of X-ray taking are also increased to make diagnoses more accurate.

On the other hand, it is also necessary to notify the results of diagnoses without delay to patients diagnosed.

Namely, there are strong demands for developing X-ray films more rapid than before so that they may be applied to diagnoses. In angiography, through-operation radiography and so forth in particular, it is intrinsically required to observe X-rayed photographs without the least delay.

In order to satisfy the above-mentioned demands in the clinical fields, it is the necessity to promote automated diagnosing procedures such as X-ray photographing, film transport and so forth and to process films more rapidly.

When carrying out a super-rapid processing, there raises the following problem; (a) Density may not be sufficient, for example, sensitivity, contrast and maximum density may be lowered; (b) Fixing may not sufficiently be performed; (c) Films may not sufficiently be washed up; (d) Films may not sufficiently be dried up; and so forth. The shortage of fixation and washing up may be the causes of varying tones and lowering image quality, during the storage of films.

One of the measures to overcome the above-mentioned problems is to reduce an amount of gelatin. However, films containing a small amount of gelatin may display a property of deteriorating the graininess of photographic images.

On the other hand, there may be another problem that the so-called black-abrasion mark is apt to cause, that is, when a film is scratched with another film or other substance and the film is then processed, a part of the film has a density higher than in the other part thereof.

As described above, the super-rapid processing has been demanded. In this specification, the super-rapid processing means the following processing:

The leading edge of a film is inserted into an automatic processor and is then delivered from the drying section of the processor after it passed through the developing tank, the first cross-over section, fixing tank, the second cross-over section, the washing tank, the third cross-over section, and the drying section. The whole period of time from the insertion of the leading edge of the film until the delivery thereof from the drying section; that is, a quotient obtained by dividing the whole length, meter, of a processing line by the transport rate, meter/second, of the line; is within the range of from 20 seconds to 60 seconds. Herein, the reason why the period of time required for passing through the cross-over sections should be included in the the above-mentioned whole period of time is that, as is well known in the art, it may be deemed that the processing is still substantially in progress in those sections, because, in the cross-over section also, the solution used in the preceeding process is still swelled in gelatin.

In Japanese Patent Publication No. 47045-1976, there is a description of the importance of the amounts of gelatin for a super-rapid processing. According to this description, it may be considered that the whole processing time including the time required for the cross-over sections is within the range of 60 to 120 seconds, that is, over 60 seconds. However, this processing time cannot satisfy the recent demands for super-rapid processing.

Recently, keeping step with the increase of medical X-ray inspections in particular, there has been a strong demand for reducing radiation dose, as the consensus of international opinions as well as of the medical and clinical circles. Accordingly, there have been the demands for the developments of photographic products capable of obtaining a precision images with a small amount of X-ray dose, namely, highly sensitive photographic products.

For making sensitivity higher with the same grain size, i.e., for sensitizing, there are a variety of techniques available. When applying a suitable sensitizing technique, it may be expected to raise a sensitivity while keeping grains constant in size, that is, while maintaining a covering power. As for the techniques, there have been reported a variety of techniques including, for example:that in which a development accelerator such as thioether or the like is added into an emulsion; that in which a spectrally sensitized silver halide emulsion is color-supersensitized by the combination of suitable dyes; that for improving an optical sensitizer is applied; and so forth.

The above-mentioned techniques may not always be said to be versatile to highly sensitive silver halide photographic light-sensitive materials. Namely, when applying the above-mentioned technique to the highly sensitive silver halide emulsions of a silver halide photographic light-sensitive material so as to perform a chemical-sensitization as high as possible, fog is apt to cause in storing the emulsions.

Further in the field of medical X-ray photographs, it was used to use a regular type X-ray films having the light-sensitive wavelength of 450 nm. Thereafter, an ortho type light-sensitive material which is so ortho-sensitized as to be sensitive to the wavelength region of 540 to 550 nm has been used. A light-sensitive material sensitized as above is widened in light-sensitive wavelength region and is increased in sensitivity, therefore, X-ray dose and bad influence on human body and so forth may be reduced. As described above, a dye sensitization is a very useful sensitizing means, however, there are still many problems remaining unsolved, such as those that a sufficient sensitivity may not be obtained by the use of some kind of photographic emulsions.

On the other hand, it is a matter of common knowledge to use an indazole and a benztriazole, as an antifoggant, in a developer. Both of these substances have been applied to both black-and-white and color developers, respectively, for this purpose. The patent specifications describing the application of this kind include, for example; U.S. Pat. No. 2,271,229 describing that an indazole type antigoggant is contained in both black-and-white and color developers; British Patent No. 1,437,053 describing that an indazole is used as an antifoggant in an X-ray developer; and U.S. Pat. No. 4,172,728 describing that an indazole is contained as an antifoggant in a developer for graphic arts use.

The indazoles and benztriazoles are very effective anti-foggants though, they have, on the other hand, a problem that a sensitivity is considerably lowered.

When a mechanical pressure of various kinds is applied before an exposure is made, there may be some instances where a pressure desensitization, i.e., a desensitization caused by mechanical pressure applied before exposure, which may be observed during a development, may be caused. In medical X-ray films, for example, there may present a phenomenon that a film may be bent by its own weight in the position where it is supported, because of a large film size. Such phenomena include, for example, creases such as the so-called knick marks and so forth. Thereby, a pressure desensitization is apt to be caused.

Recently, as a medical X-ray photographic system, an automatic exposure and developing apparatus has been popularly used. In these appratuses, a mechanical stress is applied to films. Particularly in such a dry atmosphere as wintertime, the above-mentioned pressure-blackening and black abrasion mark phenomena are apt to be caused. It is feared that such a phenomenon as mentioned above may seriously affect a medical diagnosis. Particularly with respect to the silver halide grains of a photographic light-sensitive material, it is well known that the greater the grain sizes and sensitivity are, the more a pressure desensitization is apt to cause.

For the purpose of improving the pressure desensitization, U.S. Pat. Nos. 2,628,167, 2,759,822, 3,445,235 and 2,296,204; French Patent No. 2,296,204; Japanese Patent Publication Open to Public Inspection (hereinafter called Japanese Patent O.P.I. Publication) Nos. 107129-1976 and 116025-1975; and so forth disclose that thallium and dyes are used. Among that much improved silver halide photographic light-sensitive materials, one is still insufficiently improved, another is serious in dye stain and a further one cannot always be regarded as the light-sensitive materials mainly utilizing silver halide grains having a large grain size and a normal high surface sensitivity, which is satisfactorily brought out the nature thereof.

On the other hand, there have been various attempts to improve the pressure desensitization in such a manner that the physical properties of the binders of a silver halide photographic light-sensitive material are changed. These attempts are described in, for example, U.S. Pat. Nos. 3,536,491, 3,775,128, 3,003,878, 2,759,821 and 3,772,032; Japanese Patent O.P.I. Publication Nos. 3325-1978, 56227-1975, and 147324-1975; and so forth.

In these techniques, however, the pressure desensitization may be improved though, the tackiness and dryness of film surfaces and the physical properties such as a scratch resistance and so forth are seriously deteriorated, so that the improvements may not be made to the bottom.

SUMMARY OF THE INVENTION

It is an object of the invention to provide a silver halide photographic light-sensitive material which is high in sensitivity, few in fogginess and excellent in both pressure resistance and graininess, even when it is applied to a super-rapid processing.

The objects of the invention can be achieved with a silver halide photographic light-sensitive material comprising a support bearing a hydrophilic colloidal layer including at least one light-sensitive silver halide emulsion layer thereon, wherein, the silver halide grains contained in the above-mentioned silver halide emulsion layer are mainly comprised of tabular grains which have an aspect ratio of the grain size to the grain thickness of not lower than 5, and the projective area of the whole tabular grains occupy not less than 50% of the whole projective areas of the whole silver halide grain in the emulsion layer;

the melting time of the silver halide photographic light-sensitive material is within the range of from not shorter than eight minutes to not longer than 45 minutes;

on the side bearing the hydrophilic colloidal layer containing the silver halide emulsion layer, an amount of gelatin is within the range of from 2.00 to 3.20 $g/m^2$; and by processing the light-sensitive material with an automatic processor of which the whole processing time is within the range of from 20 to 60 seconds.

It is also preferred that at least one layer of the above-mentioned silver halide photographic light-sensitive material should be hardened with at least one kind of hardeners selected from the group of vinyl sulfon type hardeners and/or halogen-substituted-S-triazine type hardeners.

The expression, 'A support bears a hydrophilic colloidal layer containing at least one light-sensitive silver halide emulsion layer thereon' or the similar expressions means that at least one light-sensitive silver halide emulsion layer is arrnged on at least one side of the support and, if required, non-light-sensitive hydrophilic colloidal layers such as a backing layer, an interlayer, a protective layer and so forth may be provided to the support.

Further in the invention; a gelatin content is reduced more than ever so as to be able to perform a super-rapid processing and a pressure desensitization which is apt to cause from the reduction of the gelatin content can be prevented by making use of tabular silver halide grains; and the graininess deterioration caused from the reduction of the gelatin content can be prevented by raising a hardening level i.e., by prolonging a melting time.

The vinyl sulfon type hardening agents preferably used in the invention include, for example, aromatic compounds such as those described in German Patent No. 1,100,942; alkyl compounds bonded with a hetero atom such as those described in Japanese Paent Publication Nos. 29622-1969 and 25373-1972; sulfonamide ester type compounds such as those described in Japanese Patent Publication No. 8736-1972; 1,3,5-tris [B-(vinyl sulfonyl)-propionyl]-hexahydro-s-triazine such as described in Japanese Patent O.P.I. Publication No. 24435-1974; alkyl ompounds such as those described in Japanese Patent O.P.I. Publication No. 44164-1976; or the like.

The typical examples (H-1) through (H-22) will be given below. It is, however, to be understood that the invention shall not be limited thereto.

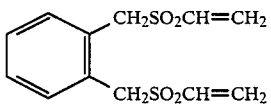

(H-1)

$CO(CH_2CH_2SO_2CH{=}CH_2)_2$ (H-2)

$NH(CH_2CH_2SO_2CH{=}CH_2)_2$ (H-3)

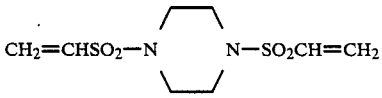

(H-4)

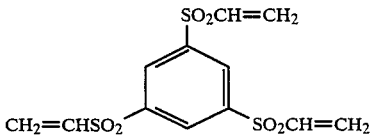

(H-5)

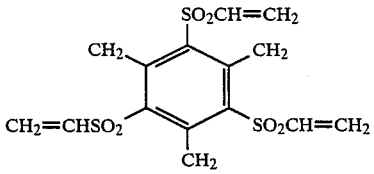

(H-6)

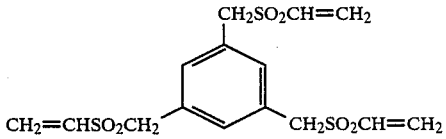

(H-7)

$CH_3C(CH_2OCH_2SO_2CH{=}CH_2)_3$ (H-8)

$C(CH_2OCH_2SO_2CH{=}CH_2)_4$ (H-9)

$N(CH_2CH_2OCH_2SO_2CH{=}CH_2)_3$ (H-10)

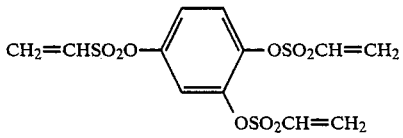

(H-11)

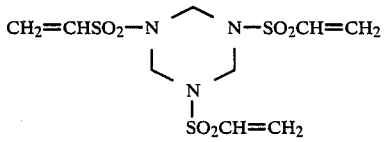

(H-12)

$C_2H_5C(CH_2SO_2CH{=}CH_2)_3$ (H-13)

$C_8H_{17}C(CH_2SO_2CH{=}CH_2)_3$ (H-14)

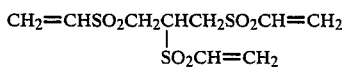

(H-15)

$(CH_2{=}CHSO_2CH_2)_3CCH_2Br$ (H-16)

$(CH_2{-}CHSO_2CH_2)_2CHCH(CH_2SO_2CH{=}CH_2)_2$ (H-17)

$(CH_2{-}CHSO_2CH_2)_3CCH_2OCH_2C(CH_2SO_2CH{=}CH_2)_3$ (H-18)

$C(CH_2SO_2CH{=}CH_2)_4$ (H-19)

-continued (H-20)

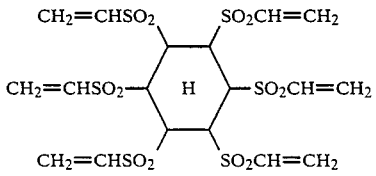

$(CH_2{=}CHSO_2CH_2)_3CCH_2SO_2CH_2CH_2C$ (H-21)

(H-22)

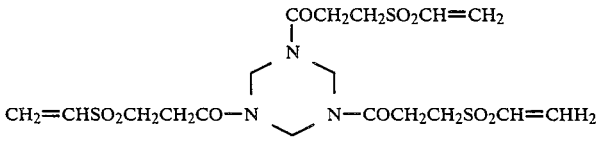

Besides the above-given exemplified compounds, the vinyl sulfon type compounds capable of being used in the invention also include a reaction product obtained by reacting a compound having at least three vinylsulfon groups in the molecular structure thereof, such as Exemplified Compounds (H-5) through (H-22), with a compound having a group reacting with a vinylsulfon group and a water-soluble group, such as diethanol amine, thio glycolic acid, sodium sarcosinate and sodium taurinate.

Next, the halogen-substituted-s-triazine type hardeners preferably include the compounds represented by the following Formula [I]or [II];

Formula [I]

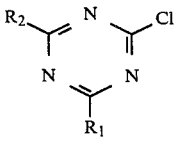

wherein, $R_1$ represents a chlorine atom or each group of hydroxy, alkyl, alkoxy, alkylthio, -OM in which M is a univalent metal atom, $-NR^1R^2$ in which $R^1$ and $R_2$ represent each a hydrogen atom or a group of alkyl or aryl, or $-NHCOR^3$ in which $R^3$ represents a hydrogen atom or a group of alkyl or aryl; and $R_2$ represents a group synonymous with the above-given $R_1$.

Formula [II]

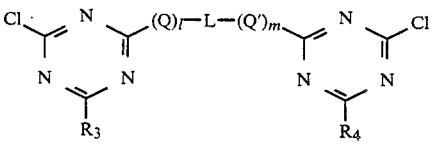

wherein $R_3$ and $R_4$ each represent a chlorine atom or a group of hydroxy, alkyl, alkoxy or —OM in which M represents a univalent metal atom; Q and Q' each represent a link selected from the group consisting of —O—, —S— and —NH—; L represents a group of alkylene or arylene; and l and m each are an integer of 0 or 1.

The typical examples (I-1) through (I-22) of the compounds represented by the above-given formulas [I]or [II]will be given below. It is, however, to be understood that the invention shall not be limited thereto.

(I-1)

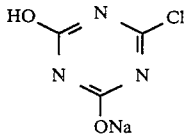

(I-2)

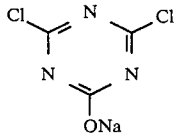

(I-3)

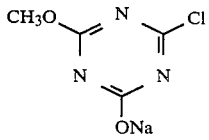

(I-4)

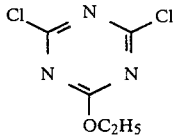

(I-5)

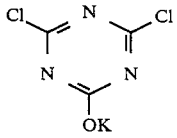

(I-6)

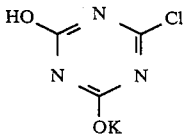

(I-7)

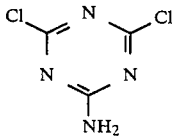

(I-8)

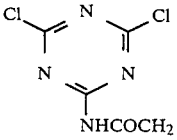

-continued (I-9)

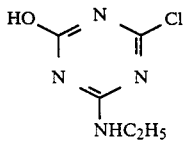

(I-10)

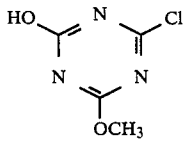

(I-11)

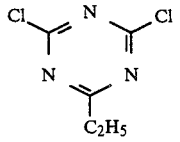

(I-12)

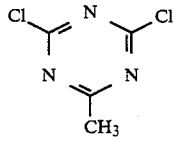

(I-13)

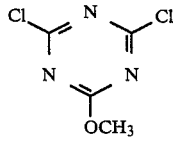

(I-14)

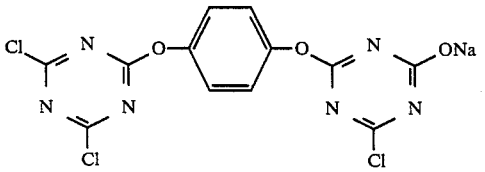

(I-15)

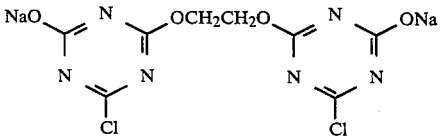

(I-16)

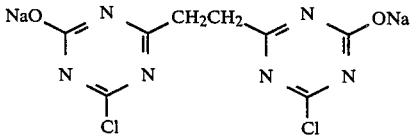

(I-17)

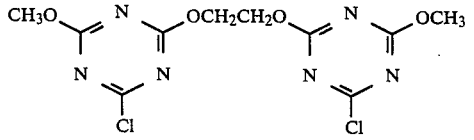

(I-18)

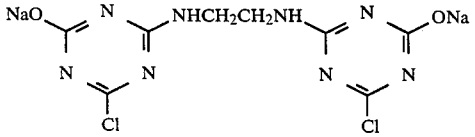

-continued (I-19)

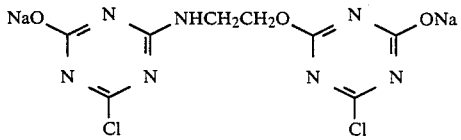

(I-20)

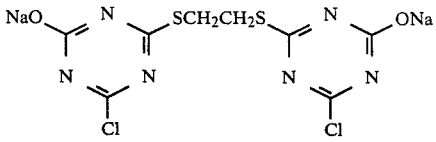

(I-21)

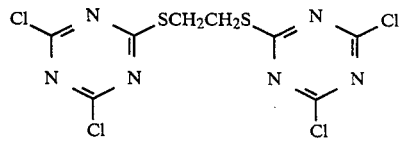

(I-22)

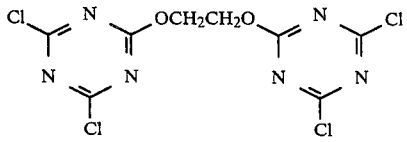

The above-mentioned vinylsulfon type of halogen-substituted-s-triazine type hardeners may be added into a silver halide emulsion layer or other component layers in such a manner that they are dissolved in either water or such a water-miscible solvent as methanol, ethanol and so forth and the resulted solution is added into a coating solution for the above-mentioned component layers. Method for adding them may be either a batch process or an in-line process. Time of adding them shall not be particularly limitative and it is, however, preferred to add them immediately before coating.

The above-mentioned hardeners may be added in an amount of from 0.5 to 100 mg and, preferably, from 2.0 to 50 mg per g of coated gelatin.

The term, melting time, used herein means a period of time from the moment when a silver halide photographic light-sensitive material cut into a size of 1 cm×2 cm is dipped into an aqueous solution of 1.5 % by weight of sodium hydroxide at 50° C. until the moment when at least one of the silver halide emulsion layers constituting the silver halide photographic light-sensitive material starts to melt.

The melting time relating to the invention can be satisfied by using a mixture of the above-mentioned hardener relating to the invention and a conventionally known hardener, provided that the invention may not be affected. For example, chromium salts such as chrome alum, chromium acetate and so forth, aldehydes such as formaldehyde, glyoxal, glutaraldehyde and so forth, N-methylol compounds such as dimethylolurea, methyloldimethyl hydantoine and so forth, dioxane derivatives such as 2,3-dihydroxydioxane and so forth, active vinyl compounds such as 1,3,5-triacryloylhexahydro-2-triazine, 1,3-vinylsulfonyl-2-propanol and so forth, active halogen compounds such as 2,4-dichloro-6-hydroxy-3-triazine and so forth, mucohalogen acids such as mucochloric acid, and mucophenoxychloric acid and so forth may be mixed independently or in the mixed state with the hardener relating to the invention, provided that the effects of the invention shall not be affected.

One of the preferable embodiments of the invention is that, in the hydrophilic colloidal layers including silver halide emulsion layers arranged on the side of a support to which a light-sensitive silver halide emulsion layer is coated, the gelatin content is from 2.00 to 3.10 g/m$^2$. In the case that the gelatin content is within the above-mentioned range, coating troubles may be reduced as compared to the case that the gelatin content is less than 2.00 g/m$^2$, and the dryness is excellent as compared to the case that the gelatin content is more than 3.10 g/m$^2$. The gelatin content is, more preferably, from 2.40 to 2.90 g/m$^2$ and, most preferably, from 2.50 to 2.80 g/m$^2$. Sensitivity, yellow stains and so forth can be more improved if the above-mentioned embodiment is made.

The supports which may be used in the invention include, for example; paper sheets laminated with polyethylene, polypropylene, α-olefin polymers such as ethylen-butene copolymer and so forth; synthetic paper sheets; a film sheets comprising a semisynthetic or synthetic macromolecule such as cellulose acetate, cellulose nitrate, polyethylene, polyvinyl chloride, polyethyleneterephthalate, polycarbonate and polyamide; and so forth.

Further, to the silver halide emulsions relating to the invention, tabular silver halide grains comprising silver bromide, silver iodobromide, silver iodochloride, silver chlorobromide, silver chloride and so forth.

The tabular silver halide grains generally take the tabular form having two parallel faces. A 'thickness' may be expressed in terms of a distance between the two parallel dominant faces constituting a tabular silver halide grain. The 'size' of the above-mentioned dominant face means a diameter of either the circular face of a grain or the face area thereof converted into a circular area, i.e., a projective area of the tabular grain. In the invention, the ratio of the size of a grain to the thickness thereof is called generally an aspect ratio which is defined as follows.

$$\text{Aspect ratio} = \frac{\text{Size of a tabular silver halide grain}}{\text{Thickness of tabular silver halide grain}}$$

In the tabular silver halide grains relating to the invention, the aspect ratio may be not lower than 5, more preferably from not lower than 5 to not higher than 40 and, particularly from not lower than 8 to not higher than 30.

Any publicly known method can be applied to prepare the above-mentioned tabular silver halide grains relating to the invention having a grain size not less than 5 times as large as the grain thickness.

For example, there is a well known method in which minute tabular silver halide grains prepared at a low pBr are added with ungrown minute silver halide grains precipitated under the same conditions therein, so that the grains can be grown up, as described in Hidemaru Sakai, 'A Study on the Preparation of Photodevelopment Type Silver Halide Light-Sensitive Materials', that is the thesis for his doctrate application.

Besides the above, there are also well known methods. For example, a method in which silver halide grains not substantially containing iodine ions are prepared at pBr of from 0.6 to 1.6 in a reaction vessel first, and then a water-soluble silver salt, a bromide and a iodide are added to the resulted grains, so that the silver halide grains are grown up, as described in Japanese Patent O.P.I. Publication No. 113928-1983; a method in which seed crystals having tabular grains of not less than 40% by weight to the total grains are formed at pBr of not higher than 1.3, so that the seed crystals are grown up while keeping the above-mentioned pBr value and with adding a water-soluble silver salt and a halide solution at the same time; a method in which seed crystals are grown up according to the prescribed correlation between pI and pBr as described in Japanese Patent O.P.I. Publication No. 151840-1987; and so forth.

When preparing the tabular silver halide grains relating to the invention, it is preferred to increase the adding rate of the water-soluble silver salt and the water-soluble halide, as the silver halide grains are being grown. When increasing the adding rate of the water-soluble silver salt and the water-soluble halide as mentioned above, the grain size distribution of the silver halide grains is monodispersed and the mixing period of time can be saved by this addition.

This is advantageous for industrial production and is also preferable from the viewpoint that the opportunity of causing a structural defect in the silver halide grains may be reduced.

In the method of increasing the adding rate of the water-soluble silver salt and the water-soluble halide, the adding rate may be increased either continuously or stepwise, as described in Japanese Patent Publication Nos. 36890-1973 and 16364-1977 and Japanese Patent O.P.I. Publication No. 142329-1980.

The upper limit of the above-mentioned adding rate may be a flow verocity immediately before the new nuclei of the silverhalide grains are produced. This flow verocity is varied according to a variety of conditions such as temperatures, pH, pAg and stirring conditions applied to the preparation of silver halide grains; the production, solubility, grain size and intergrain distance of the silver halide grains; the kinds and concentration of protective colloids; and so forth.

In the preparation of the tabular silver halide grains relating to the invention, the pH value is preferably from about 1.5 to 10 and more preferably from pH 2 to 9. As for the growth accelerators applicable to the silver halide grains in this case, the preferable ones are ammonia, a thiocyanate, a thioether, a thiourea and so forth. The preferable temperature applicable to the preparation thereof is within the range of from 35° to 90° C.

The typical examples of the growing accelerators include those described in Japanese Patent O.P.I. Publication Nos. 136736-1985, 14646-1987 and so forth. For the details of the methods of producing tabular silver halide grains relating to the invention by making use of the above-mentioned growing accelerators, it may be referred to Japanese Patent O.P.I. Publication No. 3134-1986.

In the tabular silver halide grains relating to the invention prepared in the above-mentioned methods, the thickness thereof is preferably thinner than 0.5 μm, more preferably thinner than 0.3 μm. The size thereof is preferably not smaller than 0.6 μm and more preferably not smaller than 0.8 μm, and the grain size thereof is not less than 5 times as large as the thickness thereof, preferably not less than 5 times and not more than 40 times and, more preferably not less than 8 times and not more than 30 times, respectively.

In the layers containing tabular silver halide grains used in the invention, the tabular silver halide grains constitute in an amount of not less than 40% by weight to the total silver halide grains of the layer and preferably not less than 60% by weight thereto. Further, in the tabular silver halide grains relating to the invention, the silver halide composition thereof is preferably silver iodobromide and, more preferably, silver iodobromide having a silver iodide content of from 0 to 10 mole % and, particularly, from 0.1 to 6 mole %.

To the tabular silver halide grains which is related to the invention and configurated and composed as above, including preferably silver iodobromide grains, a chemical sensitization may be applied with, preferably, a noble metal or sulfur sensitizer.

In this specification, the term, 'the whole processing time' means a period of time required both for each processing steps and each cross-over from one step to the next.

EXAMPLES

The examples of the invention will now be described indetail. It is the matter of course that the invention shall not be limited to the following examples.

Example-1

In a double-jet precipitation process and while keeping the conditions at 60° C., pAg-8.0 and pH-2.0, there prepared a silver iodobromide monodisperse type cubic crystal emulsion having a silver iodide content of 2.5 mole % and an average grain size of 0.27 um. a part of the emulsion was used as cores, so that the core grains were grown up. In the double-jet precipitation process, a solution containing the core grains and gelatin was added at 40° C., pAg=9.0 and pH=9.0 with both of an ammoniacal silver nitrate solution and a solution containing potassium iodide and potassium bromide, so that the first coating layer containing silver iodide of 30 mole % was formed. Further, in the double-jet precipitation process and at pAg=9.0 and pH-9.0, both of an ammoniacal silver nitrate solution and a potassium bromide solution were added thereto, so that the second coating layer of pure silver bromide was formed. Thus, a cubic crystal monodisperse silver iodobromide emulsion having an average grain size of 0.63 μm was prepared. The resulted emulsion was called [E-1]. The average silver iodide content of this emulsion was 2.0 mole %.

Next, in a normal precipitation process, a thik tabular emulsion [E-2]was prepared in the following manner.

First, the following two kinds of solutions were prepared.

| | | |
|---|---|---|
| Solution A: | Silver nitrate | 100 g |
| | Add water to make | 240 cc |
| Solution B: | Ossein gelatin | 8 g |
| | Potassium bromide | 80 g |
| | Potassium iodide | 1.3 g |
| | Add water to make | 550 cc |

After solution B was poured into a reaction vessel for preparing an emulsion, the solution was stirred with a propeller type stirrer having a revolution number of 300 rev/sec, and the reaction temperature was kept at 48° C.

Next, solution A was divided into two in the proportion of one part to two parts. The one part in an amount of 100 ml was added into the reaction solution, taking one minute. After stirred for 5 minutes, the remaining solution A of 200 ml, that was two parts, was then added, taking for 2 minutes. The resulted solution was stirred continuously for another 15 minutes.

Thus, emulsion [E-2]was obtained. The ratio of the grain size to the thickness thereof was four. The silver iodide content thereof was 1.3 mole % and the average grainsize thereof was 0.08 μm.

Next, tabular emulsion [E-3]was prepared in the following manner.

Into a solution containing 12 g of gelatin, 0.3 g of potassium bromide and 720 ml of water and being kept at 70° C., both of a solution containing 240 ml of water and 36 g of silver nitrate were added at the same time, taking for 30 seconds. After then, an Ostward ripening was applied to the resulted solution for 15 minutes, so that emulsion [A]containing tabular silver bromide grains was obtained.

To a part of emulsion [A], an aqueous potassium bromide solution was added and the pBr was adjusted to 0.7. After the resulted solution was added with 0.2 g of potassium iodide and was then gradually with the remaining parts of emulsion [A]as a supply-source emulsion, so that tabular silver halide iodobromide grain emulsion [E-3]was obtained.

Thus obtained tabular silver halide grains were 1.60 μm in average grain size and 13.5 in the ratio of average grain size to thickness. In this emulsion, the grains having the ratio of average grain size to thickness of not lower than five were distributed over to not less than 80% of the whole projective area of the total silver halide grains.

From emulsions [E-1]through [E-3]thus prepaed, excessive water-soluble salts were removed in a flocculation precipitation process, respectively.

To each of these emulsions, $8\times10^{-7}$ mole of chloroaurate, $7\times10^{-6}$ mole of sodium thiosulfate and $7\times10^{-4}$ mole of ammonium thiocyanate were added per mole of the silver halide used, and an optimum gold-sulfur sensitization was applied. Further, the emulsions were added with the following spectral sensitizers (43), (74) and potassium iodide in an amount of $1\times10^{-3}$ mole per mole of AgX and were then applied with an optimum spectral sensitization. The emulsions were then stabilized with 4-hydroxy-6-methyl-1,3,3a,7-tetrazaindene in an amount of $2\times10^{-2}$ mole per mole of AgX, and the gelatin concentration of the emulsions were then adjusted so as to contain the gelatin contents shown in Table 1, respectively.

Spectral sensitizer (43) - 600 mg/AgX mole

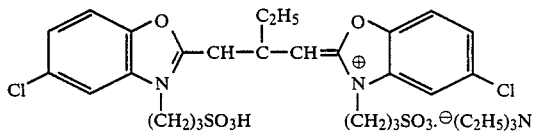

Spectral sensitizer (74) - 20 mg/AgX mole

-continued

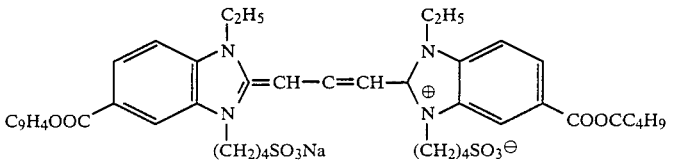

To both of the emulsions and the protective layer solutions therefor, respectively, the following additives were further added and, still further, the hardeners shown in Table 1 were added so that the melting time may be as shown in Table 1.

As the additives for emulsion layers, 400 mg of t-butylcatechol, 1.0 g of polyvinyl pyrolidone having a molecular weight of 10,000, 2.5 g of styrene-anhydrous maleic acid copolymer, 10 g of trimethylol propane, 5 g of diethylene glycol, 50 mg of nitrophenyl-triphenylphosphonium chloride, 4 g of ammonium 1,3-dihydroxybenzene-4-sulfonate, 15 mg of sodium 2-mercaptobenzimidazole-5-sulfonate, Seventy milligrams of

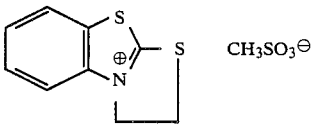

One gram of

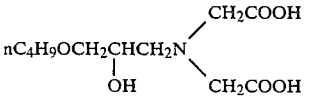

Ten milligrams of 1,1-dimethylol-1-bromo-1-nitromethane, etc.

Each of Samples No. 1 through No.20 was prepared in the following manner, respectively. Over to the both sides of a sublayered polyester film support, a protective layer having the gelatin content shown in Table 1, to which a hardener and a variety of the undermentioned additives were added so that the melting time thereof may be as shown in Table 1, as well as one of the above-mentioned emulsions, were coated at the same time in a slide-hopper process over to the both sides of a sublayered polyester film support. In the coating, the following two layers, i.e., a silver halide emulsion layer and a protetive layer, were simultaneously interlayered to the support in order from the support side at a coating speed of 60 m/min.

The silver halide emulsion layer having viscosity of 11 cp, surface tension of 35 dyn/cm and coating layer thickness of 20 μm, and the protective layer having viscosity of 11 cp, surface tension of 25 dyn/cm and coating layer thickness of 20 μm.

The silver content of each sample was 45 mg/dm$^2$,

As the additives for the protective layer, the following compounds were added per g of gelatin:

Ten milligrams of

-continued

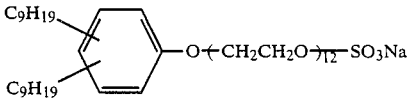

Two milligrams of

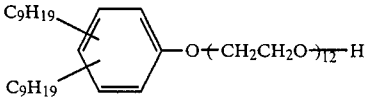

Seven milligrams of

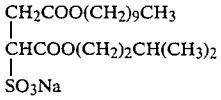

Fifteen milligrams of

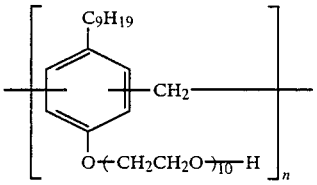

In this formula, n is a mixture of 2 to 5.

Seven milligrams of matting agent comprising polymethyl metaacrylate having an average grain size of 5 μm, Seventy milligrams of colloidal silica having an average grain size of 0.013 μm, and so forth.

In each of the samples, the hardener content was adjusted so that the melting time measured in the following manner may be the same as shown in Table 1.

In this example, the melting time was defined as a period of time from the moment when a sample which was cut into 1 cm×2 cm in size is dipped in a 15% sodium hydroxide solution being kept at 50° C. until the moment when the emulsion layer of the sample starts to be melted.

Further, the sensitivity and fogginess were measured in the following manner. Namely, a sample was sandwiched between two sheets of fluorescent intensifying screen for orthocrhomatic use, Model KO-250 (manufactured by Konishiroku Photo Ind. Co., Ltd.), and was exposed to X-rays, through an Al-wedge, at a tube voltage of 100 KVP, a tube amperage of 100 mA and for an exposure time of 0.07 second.

The samples were processed in the following steps with a roller transport type automatic process of which the whole processing time is 45 seconds.

| | Processing temperature | Processing time |
|---|---|---|
| Insterting | — | 1.2 sec |
| Developing ÷ Cross-over | 35° C. | 14.6 sec |
| Fixing ÷ Cross-over | 33° C. | 8.2 sec |
| Washing ÷ Cross-over | 25° C. | 7.2 sec |
| Squeezing | 40° C. | 5.7 sec |
| Drying | 45° C. | 8.1 sec |
| TOTAL | — | 45.0 sec |

The structure of the automatic processor used in this example was as follows.

Namely in the processor used in this example, the rubber rollers were used. Among the materials thereof, the rollers made of silicone having a stiffness of 48 degrees were used in the cross-over sections, and the rollers made of EPDM, a kind of ethylene propylene rubber, having a stiffness of 46 degrees in processing solutions were used in the processing solutions. The surface coarseness of the rollers were Dmax=4 μm, and the number of the rollers were 6 rollers in the developing section, and 84 rollers in total. The number of opposite rollers were 51 rollers and the ratio of the number of opposite rollers to the total number of the rollers was 51/84≈0.61. An amount of developer replenisher was 20 cc per sheet of 10"×12" in size, an amount of fixer replenisher was 45 cc per sheet of 10"×12" in size and an amount of washing water was 1.5 liters per minute. An airflow in the drying section was 11 $cm^2$ per minute and the heater having a capacity of 3 KW at 200V was used.

The whole processing period of time was 45 seconds as described above.

As the develope, the following developer-1 was used, and as the fixer, the following fixer-1 was used.

From the obtained characteristic curves, each of the exposure amounts was obtained in the condition of the base density plus fog density +1.0, respectively, and the relative sensitivity of each sample was obtained from the sensitivity of Sample No.1 which was regarded as the reference value of 100.

| Compositions of the developer and fixer | |
|---|---|
| Developer-1 | |
| Potassium sulfite | 55.0 g |
| Hydroquinone | 25.0 g |
| 1-phenyl-3-pyrazolidone | 1.2 g |
| Boric acid | 10.0 g |
| Sodium hydroxide | 21.0 g |
| Triethylene glycol | 17.5 g |
| 5-methylnemztriazole | 0.07 g |
| 5-nitroindazole | 0.14 g |
| 1-phenyl-5-mercapto-tetrazole | 0.015 g |
| Glutaraldehyde bisulfite | 15.0 g |
| Glacial acetic acid | 16.0 g |
| Potassium bromide | 4.0 g |
| Add triethylenetetramine hexaacetic acid to make one liter | 2.5 g |
| Fixer-1 | |
| Ammonium thiosulfate | 130.9 g |
| Sodium sulfite, anhydrous | 7.3 g |
| Boric acid | 7.0 g |
| Acetic acid of 90 wt % | 5.5 g |
| Sodium acetate, trihydrate | 25.8 g |
| Aluminum sulfate, octadecahydrate | 14.6 g |
| Sulfuric acid of 50 wt % | 6.77 g |
| Add water to make | 1 liter |

Next, the graininess of each sample was evaluated. With each of the samples processed under the above-mentioned conditions by making use of a roller-transport type automatic processor, the coarseness of the developed silver grains were visually evaluated when the density of the samples were 1.0. The results of the evaluation are ranked as 5 grades from grade 1 that was inferior to thers to grade 5 that was superior to others. In grades 3 to 5, there was no problem, however, in grades 1 and 2, the samples were not applicable to practical use.

The pressure desensitization of each sample was measured in the following manner. Namely, the humidity of the samples were adjusted for 5 hours at 23° C. and 30%Rh and they were bent at an angle of 280 degrees, approximately, with a radius of curvature of 2 cm under the above-mentioned conditions. Three minutes after they were bent, they were exposed to X-rays similar to the case of the sensitivity measurements and were then treated in the same 45 second automatic processing.

There obtained a density difference ΔD between a desensitized portion having a blackened density of 1.0 caused by bending and a portion having density of 1.0 where was not bent. According to the ΔD values, the evaluations were ranked from grade 1 to grade 5, that is, poor to excellent. The relation between the ΔD values to the evaluations are as follows.

| ΔD | Evaluation |
|---|---|
| 0 to 0.03 | 5 |
| 0.04 to 0.06 | 4 |
| 0.07 to 0.10 | 3 |
| 0.11 to 0.16 | 2 |
| 0.17 to 0.22 | 1 |

With respect to the fogginess of the samples, there obtained both of the fogginess caused 7 days after the samples were coated and the fogginess caused after the samples were heat-treated at 55° C. and 30%RH for 3 days as the substitution of the evaluation to be made in a change on standing.

The dryness was evaluated in the following manner. Namely, the samples were treated in the above-mentioned 45 second automatic processing and, with respect to the treated samples passed through the drying section, there made synthetic evaluations such as touch feeling, the degrees of stickiness to other samples and so forth. The grades of the evaluations are ranked by 5 grades from grade 1 that is inferior to others to grade 5 that is superior to others. There were no problem in grades 3 through 5, however, in grades 1 and 2, the samples were not applicable to practical use.

The sensitivity of each sample processed in the conventional 90 second automatic processing was obtained by making slower the line-speed of the above-mentioned 45 second automatic processor by one half. The results thereof are shown in Table 1.

As is obvious from Table 1, it is found that the samples relating to the invention are generally excellent in sensitivity, fogginess, pressure desensitization, graininess, dryness and so forth, and that they are suitably applicable to a super-rapid processing.

In the comparison to the conventional 90 second processing, it is also found that the samples of the invention are higher in sensitivity and, in addition, that the processing time can be shortened by one half and processability can be doubled, as compared to the conventional system applied to, for example, Samples No. 1 and No.2.

TABLE 1

| Sample No. | Emulsion No. | Gelatin content ($g/m^2$ per one side) Emulsion layer | Protective layer | Total | Hardener Kind | Amount added ($g/m^2/g$ of gelatin | Melting time (min.) | Sensitivity in 90-sec. processing | 45-sec. processing Sensitivity | Fog 7 days after coated | Fog 3 days after heat-treated | Pressure desensitization | Graininess | Dryness | Invention or not |
|---|---|---|---|---|---|---|---|---|---|---|---|---|---|---|---|
| 1 | E-1 | 2.15 | 1.15 | 3.30 | H-2 | 9 | 6 | 115 | 100 | 0.04 | 0.14 | 2 | 2 | 1 | x |
| 2 | E-1 | 2.15 | 1.15 | 3.30 | H-2 | 23 | 20 | 110 | 95 | 0.04 | 0.14 | 2 | 4 | 2 | x |
| 3 | E-1 | 2.15 | 1.15 | 3.30 | T-2 | 16 | 20 | 110 | 95 | 0.04 | 0.14 | 2 | 4 | 2 | x |
| 4 | E-1 | 2.15 | 1.15 | 3.30 | A | 24 | 20 | 110 | 95 | 0.04 | 0.15 | 2 | 4 | 2 | x |
| 5 | E-1 | 2.15 | 1.15 | 3.30 | H-2 | 95 | 60 | 95 | 80 | 0.04 | 0.14 | 2 | 5 | 3 | x |
| 6 | E-1 | 1.65 | 1.10 | 2.75 | H-2 | 9 | 6 | 140 | 125 | 0.05 | 0.14 | 2 | 2 | 2 | x |
| 7 | E-1 | 1.65 | 1.10 | 2.75 | H-2 | 23 | 20 | 135 | 120 | 0.04 | 0.14 | 2 | 3 | 3 | x |
| 8 | E-1 | 1.65 | 1.10 | 2.75 | T-2 | 16 | 20 | 135 | 120 | 0.04 | 0.14 | 2 | 3 | 3 | x |
| 9 | E-1 | 1.65 | 1.10 | 2.75 | A | 24 | 20 | 135 | 120 | 0.04 | 0.15 | 2 | 3 | 3 | x |
| 10 | E-1 | 1.65 | 1.10 | 2.75 | H-2 | 95 | 60 | 115 | 100 | 0.04 | 0.14 | 2 | 4 | 4 | x |
| 11 | E-1 | 0.90 | 1.00 | 1.90 | H-2 | 9 | 6 | 155 | 145 | 0.05 | 0.15 | 1 | 1 | 3 | x |
| 12 | E-1 | 0.90 | 1.00 | 1.90 | H-2 | 23 | 20 | 155 | 140 | 0.04 | 0.15 | 1 | 2 | 4 | x |
| 13 | E-1 | 0.90 | 1.00 | 1.90 | T-2 | 16 | 20 | 155 | 140 | 0.04 | 0.15 | 1 | 2 | 4 | x |
| 14 | E-1 | 0.90 | 1.00 | 1.90 | A | 24 | 20 | 155 | 140 | 0.04 | 0.16 | 1 | 2 | 4 | x |
| 15 | E-1 | 0.90 | 1.00 | 1.90 | H-2 | 95 | 60 | 135 | 120 | 0.04 | 0.15 | 1 | 3 | 5 | x |
| 16 | E-2 | 2.15 | 1.15 | 3.30 | H-4 | 10 | 6 | 95 | 85 | 0.04 | 0.15 | 3 | 2 | 1 | x |
| 17 | E-2 | 2.15 | 1.15 | 3.30 | H-4 | 25 | 20 | 95 | 80 | 0.04 | 0.15 | 3 | 4 | 2 | x |
| 18 | E-2 | 2.15 | 1.15 | 3.30 | I-3 | 16 | 20 | 95 | 80 | 0.04 | 0.15 | 3 | 4 | 2 | x |
| 19 | E-2 | 2.15 | 1.15 | 3.30 | A | 24 | 20 | 95 | 80 | 0.04 | 0.16 | 3 | 4 | 2 | x |
| 20 | E-2 | 2.15 | 1.15 | 3.30 | H-4 | 105 | 60 | 85 | 65 | 0.04 | 0.15 | 3 | 5 | 3 | x |
| 21 | E-2 | 1.65 | 1.10 | 2.75 | H-4 | 10 | 6 | 125 | 110 | 0.05 | 0.15 | 3 | 2 | 2 | x |
| 22 | E-2 | 1.65 | 1.10 | 2.75 | H-4 | 25 | 20 | 120 | 105 | 0.04 | 0.15 | 3 | 3 | 3 | x |
| 23 | E-2 | 1.65 | 1.10 | 2.75 | I-3 | 16 | 20 | 120 | 105 | 0.04 | 0.15 | 3 | 3 | 3 | x |
| 24 | E-2 | 1.65 | 1.10 | 2.75 | A | 24 | 20 | 120 | 105 | 0.04 | 0.16 | 3 | 3 | 3 | x |
| 25 | E-2 | 1.65 | 1.10 | 2.75 | H-4 | 105 | 60 | 100 | 90 | 0.04 | 0.15 | 3 | 4 | 4 | x |
| 26 | E-2 | 0.90 | 1.00 | 1.90 | H-4 | 10 | 6 | 140 | 130 | 0.05 | 0.16 | 2 | 1 | 3 | x |
| 27 | E-2 | 0.90 | 1.00 | 1.90 | H-4 | 25 | 20 | 140 | 125 | 0.05 | 0.16 | 2 | 2 | 4 | x |
| 28 | E-2 | 0.90 | 1.00 | 1.90 | I-3 | 16 | 20 | 140 | 125 | 0.05 | 0.16 | 2 | 2 | 4 | x |
| 29 | E-2 | 0.90 | 1.00 | 1.90 | A | 24 | 20 | 140 | 125 | 0.05 | 0.17 | 2 | 2 | 4 | x |
| 30 | E-2 | 0.90 | 1.00 | 1.90 | H-4 | 105 | 60 | 120 | 110 | 0.04 | 0.16 | 2 | 3 | 5 | x |
| 31 | E-3 | 2.15 | 1.15 | 3.30 | I-2 | 7 | 6 | 125 | 115 | 0.03 | 0.07 | 5 | 3 | 1 | x |
| 32 | E-3 | 2.15 | 1.15 | 3.30 | I-2 | 16 | 20 | 120 | 110 | 0.03 | 0.07 | 5 | 4 | 2 | x |
| 33 | E-3 | 2.15 | 1.15 | 3.30 | I-7 | 25 | 20 | 120 | 110 | 0.03 | 0.07 | 5 | 4 | 2 | x |
| 34 | E-3 | 2.15 | 1.15 | 3.30 | A | 24 | 20 | 115 | 105 | 0.03 | 0.14 | 5 | 4 | 2 | x |
| 35 | E-3 | 2.15 | 1.15 | 3.30 | I-2 | 80 | 60 | 100 | 90 | 0.03 | 0.07 | 5 | 5 | 3 | x |
| 36 | E-3 | 1.95 | 1.15 | 3.10 | H-2 | 9 | 6 | 140 | 130 | 0.03 | 0.07 | 5 | 3 | 2 | x |
| 37 | E-3 | 1.95 | 1.15 | 3.10 | H-2 | 23 | 20 | 135 | 125 | 0.03 | 0.07 | 5 | 4 | 3 | o |
| 38 | E-3 | 1.95 | 1.15 | 3.10 | H-4 | 25 | 20 | 135 | 125 | 0.03 | 0.07 | 5 | 4 | 3 | o |
| 39 | E-3 | 1.95 | 1.15 | 3.10 | A | 24 | 20 | 130 | 120 | 0.03 | 0.14 | 5 | 4 | 3 | o |
| 40 | E-3 | 1.95 | 1.15 | 3.10 | H-2 | 95 | 60 | 110 | 105 | 0.03 | 0.07 | 5 | 4 | 4 | x |
| 41 | E-3 | 1.65 | 1.10 | 2.75 | H-2 | 9 | 6 | 150 | 140 | 0.03 | 0.07 | 5 | 2 | 2 | x |
| 42 | E-3 | 1.65 | 1.10 | 2.75 | H-4 | 10 | 6 | 150 | 140 | 0.03 | 0.07 | 4 | 2 | 2 | x |
| 43 | E-3 | 1.65 | 1.10 | 2.75 | A | 9 | 6 | 145 | 135 | 0.03 | 0.14 | 4 | 2 | 2 | x |
| 44 | E-3 | 1.65 | 1.10 | 2.75 | H-2 | 14 | 10 | 155 | 145 | 0.03 | 0.07 | 4 | 3 | 3 | o |
| 45 | E-3 | 1.65 | 1.10 | 2.75 | H-2 | 23 | 20 | 160 | 150 | 0.03 | 0.07 | 4 | 4 | 3 | o |
| 46 | E-3 | 1.65 | 1.10 | 2.75 | H-4 | 25 | 20 | 160 | 150 | 0.03 | 0.07 | 4 | 4 | 3 | o |
| 47 | E-3 | 1.65 | 1.10 | 2.75 | H-2 | 16 | 20 | 160 | 150 | 0.03 | 0.07 | 4 | 4 | 3 | o |
| 48 | E-3 | 1.65 | 1.10 | 2.75 | A | 24 | 20 | 155 | 145 | 0.04 | 0.15 | 4 | 4 | 3 | o |
| 49 | E-3 | 1.65 | 1.10 | 2.75 | H-4 | 70 | 40 | 150 | 140 | 0.03 | 0.07 | 4 | 4 | 4 | o |
| 50 | E-3 | 1.65 | 1.10 | 2.75 | H-4 | 105 | 60 | 115 | 110 | 0.03 | 0.07 | 4 | 4 | 4 | x |
| 51 | E-3 | 1.65 | 1.10 | 2.75 | I-3 | 80 | 60 | 115 | 110 | 0.03 | 0.07 | 4 | 4 | 4 | x |
| 52 | E-3 | 1.65 | 1.10 | 2.75 | A | 75 | 60 | 115 | 100 | 0.04 | 0.16 | 4 | 4 | 4 | x |
| 53 | E-3 | 1.20 | 1.00 | 2.20 | I-2 | 7 | 6 | 165 | 160 | 0.03 | 0.07 | 4 | 2 | 3 | x |
| 54 | E-3 | 1.20 | 1.00 | 2.20 | I-2 | 16 | 20 | 165 | 155 | 0.03 | 0.07 | 4 | 3 | 3 | o |
| 55 | E-3 | 1.20 | 1.00 | 2.20 | H-2 | 23 | 20 | 165 | 155 | 0.03 | 0.07 | 4 | 3 | 3 | o |
| 56 | E-3 | 1.20 | 1.00 | 2.20 | A | 24 | 20 | 160 | 150 | 0.04 | 0.16 | 4 | 3 | 4 | o |
| 57 | E-3 | 1.20 | 1.00 | 2.20 | H-4 | 105 | 60 | 135 | 130 | 0.03 | 0.07 | 3 | 4 | 5 | x |
| 58 | E-3 | 0.90 | 1.00 | 1.90 | I-2 | 7 | 6 | 165 | 160 | 0.04 | 0.10 | 2 | 1 | 3 | x |
| 59 | E-3 | 0.90 | 1.00 | 1.90 | H-2 | 23 | 20 | 160 | 155 | 0.04 | 0.10 | 2 | 2 | 4 | x |
| 60 | E-3 | 0.90 | 1.00 | 1.90 | H-4 | 25 | 20 | 160 | 155 | 0.04 | 0.10 | 2 | 2 | 4 | x |
| 61 | E-3 | 0.90 | 1.00 | 1.90 | A | 24 | 20 | 155 | 150 | 0.05 | 0.18 | 2 | 2 | 4 | x |
| 62 | E-3 | 0.90 | 1.00 | 1.90 | H-4 | 105 | 60 | 130 | 125 | 0.05 | 0.11 | 2 | 3 | 5 | x |

o: Invention
x: Other than invention

As described above, according to the invention, a silver halide photographic light-sensitive material can be so prepared as to display a high sensitivity even if it is super-rapidly processed; a low fogginess even immediately after it is coated and after it is heat-treated; an excellent pressure resistance; and an excellent graininess.

What is claimed is:

1. A silver halide photographic light-sensitive material comprising a support bearing a hydrophilic colloidal layer including at least one light sensitive silver halide emulsion layer thereon, wherein silver halide grains contained in the said silver halide emulsion layer are mainly comprised of tabular grains which have an aspect ratio of the grain size to the grain thickness of not lower than 5, and the projective areas of the whole tabular grain occupy not less than 50% of the projective areas of the whole silver halide grain in said emulsion layer, the melting time of said silver halide photographic light-sensitive material is within the range of from not shorter than 8 minutes to not longer than 45 minutes, and on the side bearing the hydrophilic colloidal layer containing said silver halide emulsion layer, an amount of gelatin is within the range of from 2.00 to 3.20 g/m$^2$.

2. The silver halide photographic light-sensitive material of claim 1, wherein at least one layer of said silver halide photographic light-sensitive material is hardened with at least one of the hardeners selected from the group consisting of vinylsulfon type hardeners and halogen substituted-s-triazine type hardeners.

3. The silver halide photographic light-sensitive material of claim 1, wherein said aspect ratio of the tabular grains is within the range of from 5 to 40.

4. The silver halide photographic light-sensitive material of claim 3, wherein said aspect ratio of the tabular grains is within the range of from 8 to 30.

5. The silver halide photographic light-sensitive material of claim 1, wherein the thickness of said tabular grains is thinner than 0.5 μm.

6. The silver halide photographic light-sensitive material of claim 5, wherein the thickness of said tabular grain is thinner than 0.3 μm.

7. The silver halide photographic light-sensitive material of claim 1, wherein the size of said tabular grains is not smaller than 0.6 μm.

8. The silver halide photographic light-sensitive material of claim 7, wherein the size of said tabular grains is not smaller than 0.8 μm.

9. The silver halide photographic light-sensitive material of claim 1, wherein an amount of gelatin is within the range of from 2.40 to 2.90 g/m$^2$.

10. The silver halide photographic light-sensitive material of claim 9, wherein an amount of gelatin is within the range of from 2.50 to 2.80 g/m$^2$.

11. The silver halide photographic light-sensitive material of claim 1, wherein said tabular grains are composed of silver iodobromide.

12. The silver halide photographic light-sensitive material of claim 11, wherein said tabular grains are composed of silver iodobromide containing 0 to 10 mol% of silver iodide.

13. The silver halide photographic light-sensitive material of claim 12, wherein said tabular grains are composed of silver iodobromide containing 0.1 to 6 mol% of silver iodide.

14. A method for processing a silver halide photographic light-sensitive material comprising a support bearing a hydrophilic colloidal layer including at least one light sensitive silver halide emulsion layer thereon, wherein silver halide grains contained in the said silver halide emulsion layer are mainly comprised of tabular grains which have an aspect ratio of the grain size to the grain thickness of not lower than 5, and the projective areas of the whole tabular grain occupy not less than 50% of the projective areas of the whole silver halide grain in said emulsion layer, the melting time of said silver halide photographic light-sensitive material is within the range of from not shorter than 45 minutes, and on the side bearing the hydrophilic colloidal layer containing said silver halide emulsion layer, an amount of gelatin is within the range of from 2.00 to 3.20 g/m$^2$; in which said silver halide photographic material is processed with an automatic processor of which the whole processing time is within the range of from 20 to 60 seconds.

* * * * *